United States Patent [19]

Muir

[11] Patent Number: 5,060,359

[45] Date of Patent: Oct. 29, 1991

[54] TOOL FOR SEATING A LOCKBOLT FASTENER

[76] Inventor: Jon W. Muir, The Boeing Company, P.O. Box 3707, M.S. 7E-25, Seattle, Wash. 98124

[21] Appl. No.: 411,917

[22] Filed: Sep. 25, 1989

[51] Int. Cl.[5] ..... B23P 19/04

[52] U.S. Cl. ..... 29/244; 29/252; 81/44

[58] Field of Search ..... 29/214, 255, 280, 281, 29/282, 244, 252; 81/44

[56] References Cited

U.S. PATENT DOCUMENTS

| | | | |
|---|---|---|---|
| 714,989 | 12/1902 | Worthington . | |
| 1,472,349 | 11/1922 | Winchler . | |
| 1,548,835 | 11/1923 | French . | |
| 1,853,356 | 11/1929 | Houck . | |
| 2,467,982 | 4/1949 | Maris | 24/914 |
| 2,482,331 | 11/1949 | Greene | 29/281 X |
| 3,120,700 | 1/1961 | Chuplis, Jr. . | |
| 3,367,011 | 2/1968 | Sipher | 29/280 |
| 3,507,028 | 4/1970 | Stellatella | 29/280 X |
| 3,613,212 | 10/1971 | Miller | 29/281 X |
| 3,807,028 | 4/1974 | DeLuca . | |
| 4,057,886 | 11/1977 | Brass | 29/280 X |
| 4,263,713 | 4/1981 | Smith et al. | 29/282 X |
| 4,724,608 | 2/1988 | Parrott | 29/280 X |

OTHER PUBLICATIONS

Aerospace Nose Assemblies for Lockbolt Fasteners, Huck Manufacturing Company, Kingston, New York.

Huck Combines Cost Effectiveness with High Strenghth, Huck Manufacturing Company, Carson, California.

*Primary Examiner*—Timothy V. Eley

*Attorney, Agent, or Firm*—Hughes & Multer

[57] ABSTRACT

Methods and tools for installing fasteners of the lockbolt type. The fastener is pulled through cooperating apertures in a stackup of parts being joined by a tool with jaws which can be closed to grip the pintail of the fastener and then retracted to seat the fastener. A collar is swaged onto a grooved section of the fastener's shank and the pintail is broken off to complete the installation of the fastener.

6 Claims, 4 Drawing Sheets

TOOL FOR SEATING A LOCKBOLT FASTENER

TECHNICAL FIELD OF THE INVENTION

The present invention relates to fastening systems of the lockbolt type. It more particularly relates, in one aspect, to a novel method and a novel tool for pulling a lockbolt through a stackup of components so that a collar can be swaged onto the lockbolt to form a permanent connection between the lockbolt and collar, thereby fastening the components together.

BACKGROUND OF THE INVENTION

Lockbolt fasteners are used extensively in the aircraft industry and elsewhere to fasten airframe and other components together. Lockbolts are employed in lieu of rivets, bolts, and other fasteners because they combine high strength with cost effectiveness.

Fasteners of the lockbolt type have a head, a shank with grooved locking rings for a collar-type retainer, and a pintail. After the fastener is installed, the collar is swaged onto that section of the fastener shank with the locking rings and the pintail of the fastener broken off, completing the fastener installation process.

Lockbolt fasteners are installed by hand starting them in previously prepared holes in the components being joined. However, because of the tight tolerances commonly found in the applications in which lockbolts are employed, friction between the fasteners and components being joined is high; greater forces than can be exerted by hand are required to seat the fasteners; and mechanical devices must be employed for that purpose.

A rivet gun is the tool commonly employed to drive into place and seat lockbolt fasteners. This, however, has a number of disadvantages. One is the noise generated by a rivet gun; a second is that the use of a rivet gun in this fashion is not compatible with the automation of assembly lines by robotics. And, lockbolt fasteners must often be installed in close enough quarters that a rivet gun cannot be used to pound on the head of the rivet.

SUMMARY OF THE INVENTION

I have now invented, and disclosed herein, a novel and improved technique for seating fasteners of the lockbolt type.

First, the fastener is by hand pushed through apertures in the components to be joined until at least two or three of the threads on the pintail of the fastener are accessible from the exterior of the assembly of components. This is easily accomplished because the pintail has a smaller diameter than the shank of the fastener. Consequently, there is a loose fit between the pintail and the components being assembled; and the fastener can therefore be easily pushed through the stackup of components until the shank of the fastener reaches the stackup. With a stackup of appropriate thickness, this will expose the requisite threads on the pintail of the fastener.

Next, a tool with cooperating, externally extendable jaws is placed over the protruding part of the pintail, and the jaws are closed to couple them to the fastener. Then, the jaws are retracted, pulling the fastener through the components being joined until the head of the fastener is seated against the assembly or stackup.

Once the fastener is seated, a collar is slid onto the grooved section of the shank (exposed by the seating of the fastener on the side of the stackup opposite that side engaged by the head of the fastener). This collar is swaged onto the grooved section of the fastener while tension is exerted on the pintail to securely join the components of the assembly together. As the swaging step is completed, the pintail of the fastener is automatically broken off, completing installation of the fastener.

This novel technique for seating and then completing the installation of lockbolt fasteners has the advantage of eliminating the noise generated by the rivet guns currently used to pound on the heads of and seat lockbolt fasteners. Also, by employing my lockbolt seating technique, lockbolts can be used in locations where they might otherwise be impractical because there is not enough room to pound on the head of the fastener. Furthermore, the above-discussed technique for seating lockbolt fasteners lends itself to the automation of assembly procedures with robotics.

Aside from the foregoing, the novel fastener seating tools disclosed herein are relatively simple, rugged, and easy to learn to use.

THE PRIOR ART

Tools for seating lockbolt fasteners by pulling on the fastener have heretofore been made available by Huck Manufacturing Co., Kingston, N.Y., and Carson, Calif. and described in the Huck brochures entitled Aerospace Nose Assemblies For Lockbolt Fasteners and Huck Combines Cost Effectiveness With High Strength. The Huck tools, however, have jaw assemblies which are housed entirely within the nose piece of the tool, even in their most extended—i.e., initialized—positions. As a consequence, all or at least a large portion of the pintail must be exposed before a Huck tool can grip it and be used to seat the fastener because the pintail must extend well into the fastener seating tool so that it can be gripped by the jaws of the tool. Thus: (1) mechanical driving of the fastener as with a rivet gun must be resorted to to expose the requisite length of pintail, or (2) use of the Huck tool must be restricted to relatively thin stacks of parts. In this respect, the pintails of all lockbolt fasteners have the same length, even though the grip lengths of these fasteners—i.e., the length of the shank—can be different. Because of the shorter length of pintail that needs to be exposed, employing a tool in accord with the principles of the present invention allows one to assemble a thicker stack of components—either thicker components or an increased number—than has heretofore been possible in applications involving the seating of lockbolt fasteners by pulling (in a typical application of the present invention, the protrusion needed for the tool to grip the pintail of the fastener will typically be less than one-third of that required by a Huck type tool). This is of course an obvious and important advantage from design, assembly, and other viewpoints such as cost reduction.

OBJECTS OF THE INVENTION

From the foregoing, it will be apparent to the reader that one important and primary object of the present invention resides in the provision of novel, improved methods for seating lockbolt fasteners.

Yet another important and primary object of the present invention is the provision of novel tools for seating lockbolt fasteners.

Related and also important but more specific objects of my invention are the provision of methods and tools as characterized in the preceding paragraph:.

which abate the noise generated by the rivet guns heretofore employed to pound lockbolt fasteners into place;

which are compatible with robotic-employing automation of assembly lines;

which can be employed to seat fasteners in locations where the head of the lockbolt can not be reached by a rivet gun or other tool.

Still other important objects of the invention resides in the provision of fastener seating tools:

which are rugged and relatively simple;

which can be used with no more than rudimentary instruction;

which can be employed to seat lockbolt fasteners in thicker stackups of components than has heretofore been possible with tools designed to seat lockbolt fasteners by pulling them in place.

Other important objects and features and additional advantages of my invention will be apparent to the reader from the foregoing and the appended claims and as the ensuing detailed description and discussion proceeds in conjunction with the accompanying drawings.

DETAILED DESCRIPTION OF THE INVENTION

Figure 1:
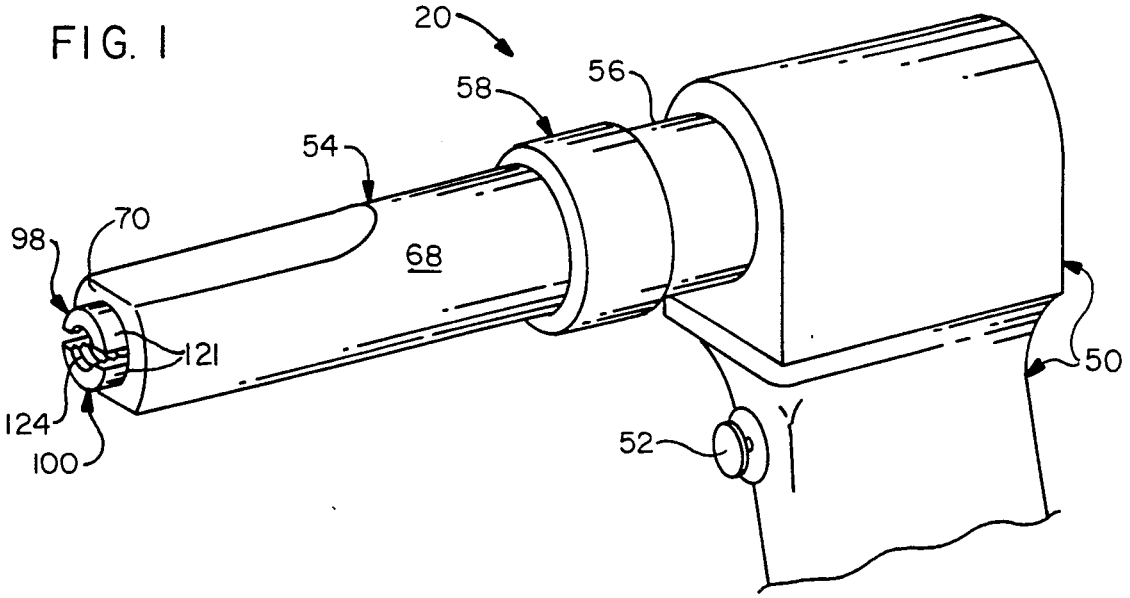
FIG. 1 is a pictorial view of a fastener seating tool constructed in accord with the principles of the present invention and designed to be used in accord with those principles to seat a lockbolt fastener.

Referring now to the drawings, FIG. 1 depicts a tool 20 which is constructed in accord with the principles of the present invention and designed to seat fasteners of the lockbolt type. A lockbolt fastener—identified by reference character 22 in FIGS. 2–6—may be used in lieu of rivets, bolts, and the like to join together a stackup 23 of components such as those identified by reference characters 24 and 26.

As is shown in FIGS. 2–6, lockbolt 22 has a head 28; a shank 30 with a section in which parallel grooves 34 are formed; and a pintail 36. The pintail has parallel, spaced apart ridges 38 and is connected to shank 30 by a necked down transition section 40. The diameter of shank 30 is given an interference fit with components 24 and 26 to produce a joint with maximum strength whereas the diameter of pintail 36 is somewhat smaller. Consequently, fastener 22 can be easily pushed through the aligned apertures 44 and 46 in assembled components 24 and 26 by hand until the shank 30 of the fastener reaches the exposed surface 48 of component 24 (see FIG. 2). Thereafter, it becomes necessary to resort to a mechanical device to seat fastener 22; i.e., to further displace it in the direction indicated by arrow 49 until head 28 butts against exposed surface 48. As discussed above, this has heretofore and is currently being accomplished by using a rivet gun to pound on the head 28 of lockbolt fastener 22; but this approach which does not lend itself to automation, generates high noise levels, and is not useful in tight quarters.

The tool 20 illustrated in FIG. 1 is employed to seat lockbolt fastener 22 with the alleviation of the foregoing problems.

Tool 20 has a grip 50 supporting an operator accessible actuator 52 and an elongated, barrellike nose housing 54. This housing is coupled to a hollow cylindrical, stub housing 56 on the front end of handle or grip 50 by a threaded connector 58.

Figure 2:
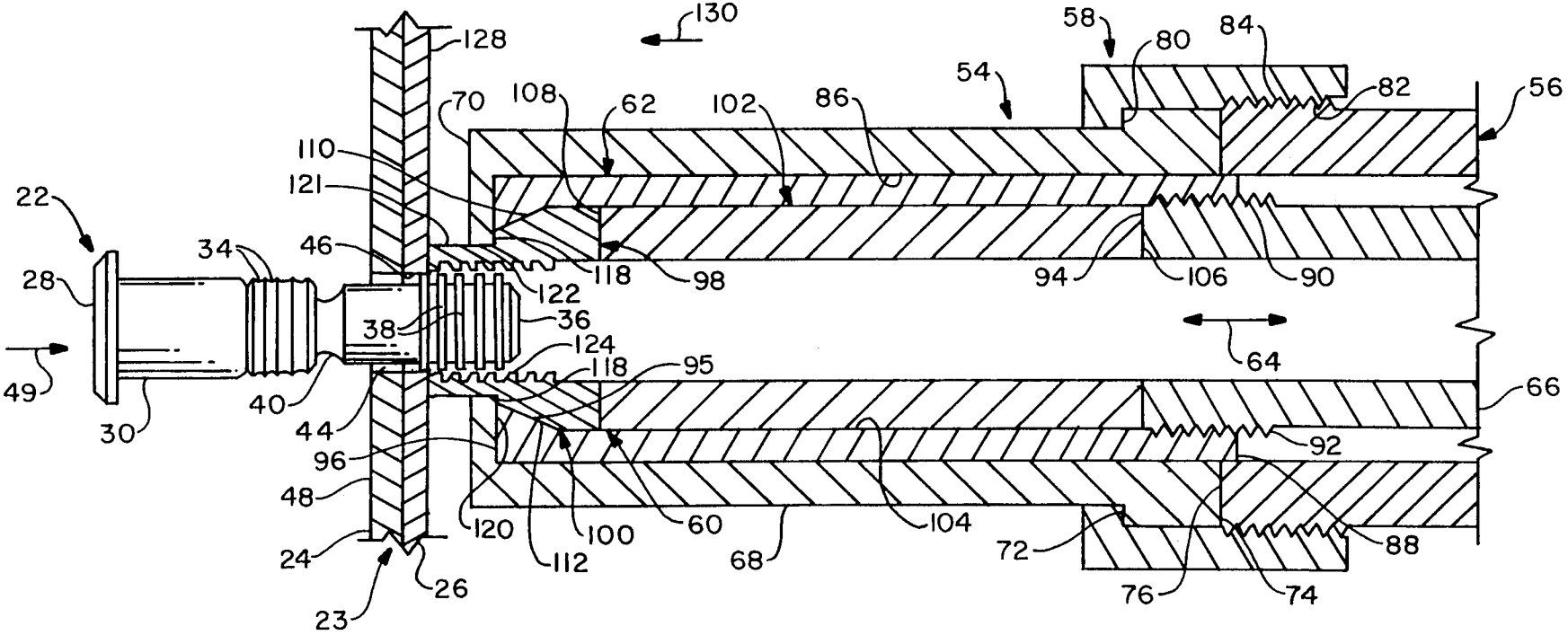
FIG. 2 is a section through the tool of FIG. 1 and a lockbolt started through a stackup of two components that are to be joined together by the lockbolt.
Figure 4:
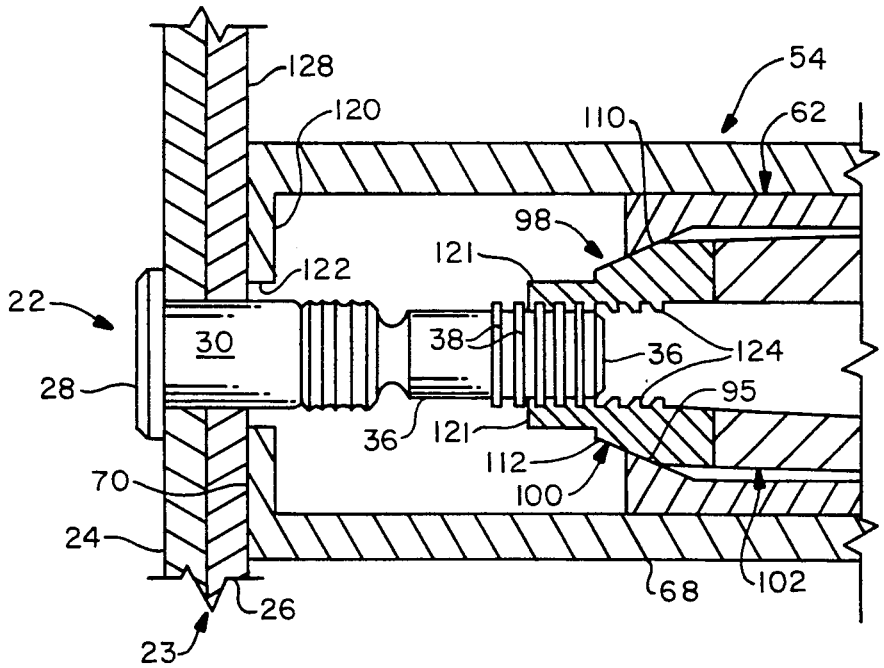
FIG. 4 is a view similar to FIG. 3 but with the jaws of fastener seating tool retracted to pull the lockbolt through the components being joined and thereby seat it.

Located in nose housing 54 are a jaw assembly 60, a collet 62, and a mechanism for effecting bidirectional rectilinear displacement of collet 62 in housing 54 as indicated by double-headed arrow 64 in FIG. 2. This mechanism includes a tubular collet actuator 66 threaded into the rear end of collet 62. The other components of the mechanism for rectilinearly displacing collet 62 are not part of the present invention and are furthermore commercially available in the LGP installation tools manufactured by the Huck Manufacturing Company and described in the Huck brochures identified above. Therefore, the actuator mechanism components in question will not be described herein.

Tool 20 will typically be either pneumatically or hydraulicly powered.

Referring now especially to FIGS. 2–5, the elongated nose casing 54 of tool 20 has a cylindrical side wall 68 and a flat front wall 70 with an annular ledge 72 toward the rear end 74 of the housing side wall. This end of the housing is butted against the forward end 76 of the stub housing 56 projecting from tool handle 50.

As indicated above, nose housing 54 is coupled to stub housing 56 by retainer 58. The latter is a cylindrical member which has a sliding fit with the rear end 74 of nose housing side wall 68, a radial ledge 80 which butts against the ledge 72 on nose housing side wall 68, and internal threads 82 which complement the external threads 84 on the forward end 76 of stub housing 56. As will be apparent to the reader from the foregoing and FIGS. 2–5, the installation of connector 58 on nose housing 54 and the subsequent threading of the connector onto stub housing 56 aligns the two housings 54 and 56 and securely clamps them together.

Referring still to FIGS. 2–5, collet 62 is an elongated, hollow, cylindrical member with a sliding fit in the bore 86 through the nose housing 54 of tool 20. At the rear end 88 of the collet, internal threads 90 cooperate with external threads 92 at the forward end 94 of collet actuator 66 to couple the collet and collet actuator together.

An internal, tapered cam surface 95 extends at an acute angle from the front end 96 of collet 62 toward the rear end 88 of that component.

The cooperating jaw assembly 60 of tool 20 referred to briefly above has two opposing jaws 98 and 100 and a jaw support 102. The latter is a tube of resiliently compressible material such as a synthetic rubber. This tube is seated in the bore 104 through collet 62. Its rear end 106 butts against the front end 94 of collet actuator 66, and jaws 98 and 100 butt against the front end 108 of tube 102.

Jaws 98 and 100 have external, tapered cam surfaces 110 and 112 which match the internal cam surface 95 of collet 62. Each of the two jaws 98 and 100 also has a ledge 118 engageable with the inner surface 120 of nose housing front wall 70; a segment 121 which can be extended through a central opening 122 in end wall 70; and parallel, spaced apart teeth 124 which are spaced and configured to be fit over the external ridges 38 on lockbolt fastener pintail 36. Teeth 124 are formed in and well beyond the protruding sections 121 of jaws 98 and 100.

As indicated above, the first step in installing lockbolt fastener 22 is to manually start fastener 22 through the aligned openings 44 and 46 in the stackup 23 of components 24 and 26 until at least two or three of the external ridges 38 on the pintail 36 of fastener 22 are exposed; i.e., protrude beyond the exterior surface 128 of structural component 26—so that they can be engaged by the teeth 124 on the protruding segments 121 of jaws 98 and 100. Next, tool 20 with jaws 98 and 100 protruding beyond the end wall 70 of nose housing 54 is slid over the exposed portion of pintail 36 in the direction indicated by arrow 130 in FIG. 2 until jaws 98 and 100 engage the exposed surface 128 of assembly component 26. Then, the operator depresses tool actuator 52, which results in collet 62 being moved to the right (see arrow 64 in FIG. 2) relative to nose housing 54 from the initialized position shown in that figure to the position shown in FIG. 3. As this occurs, the movement of the cam surface 95 on the collet relative to the cam surfaces 110 and 112 on jaws 98 and 100 displaces the jaws toward each other. This clamps the pintail 36 of fastener 22 between jaws 98 and 100 with the teeth 124 on the jaws located between the external ridges 38 on pintail 36. That provides a secure connection between jaw assembly 60 and pintail 36.

Figure 3:
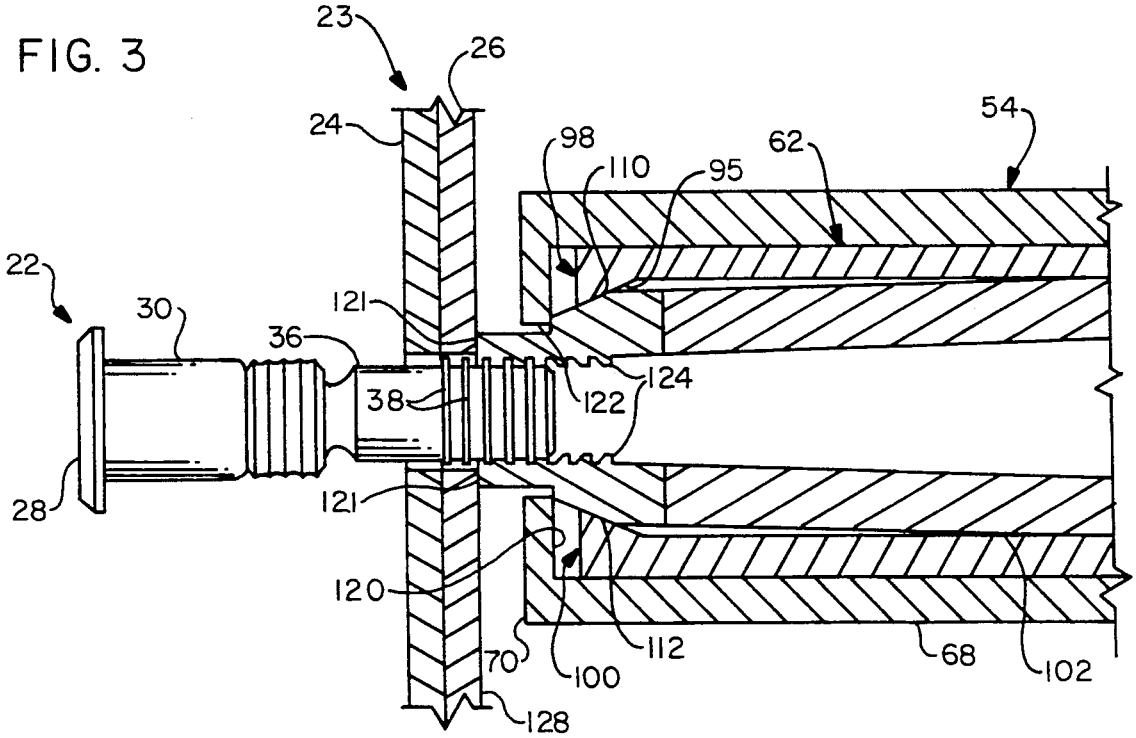
FIG. 3 is a view similar to FIG. 2 but with the pintail of the lockbolt clamped between jaws of the fastener seating tool.

Once jaws 98 and 100 have been displaced toward each other to the closed positions shown in FIG. 3, further relative longitudinal movement between the jaws and collet 62 is precluded. Therefore, the collet and jaws 98 and 100 thereafter move as a unit to right relative to nose housing 54 as collet actuator 66 is retracted further because the nose housing moves into contact with stack-up component 26 (see FIG. 4) and cannot move further to the left. This continues until fastener 22 has been pulled through assembled components 24 and 26 far enough for its head 28 to be seated against the exposed surface 48 of component 24 (see FIG. 4). At this point the operator releases actuator 52 to turn off tool 20.

During the just-described clamping of jaws 98 and 100 onto the pintail 36 of fastener 22 and the subsequent displacement of the jaw assembly and fastener, resilient jaw support 102 exerts forces acting in the direction of arrow 130 in FIG. 2 on jaws 98 and 100. This keeps the external cam surfaces 110 and 112 on jaws 98 and 100 in firm contact with the internal cam surface 95 at the front end 94 of collet 62. Such contact ensures that jaws 98 and 100 remain closed during the retraction of the jaws and collet 62 to seat fastener 22.

Figure 5:
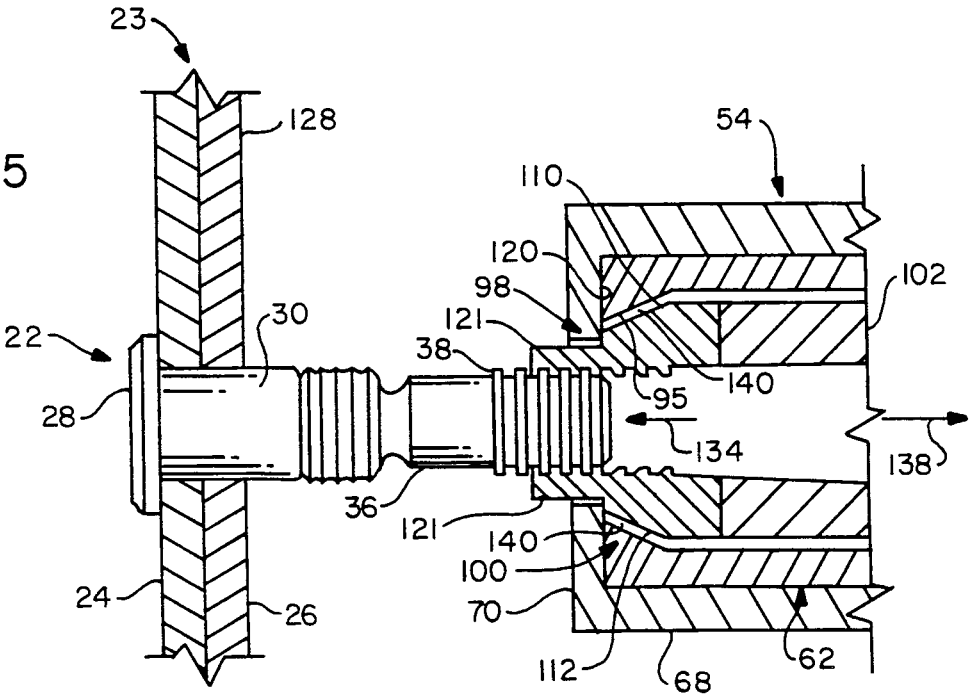
FIG. 5 is a view like FIG. 4 but with the jaws released so that the tool can be removed from the seated lockbolt fastener.
Figure 6:
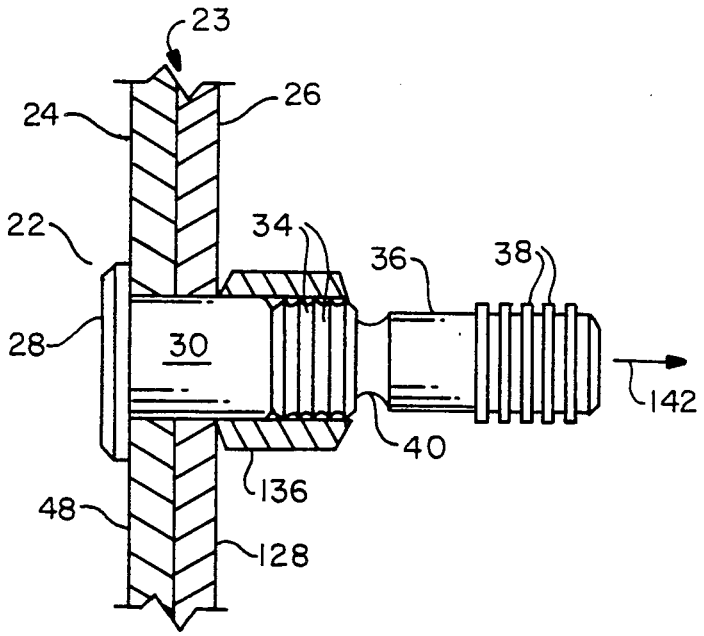
FIG. 6 is a view of the components being joined with the fastener seated and a collar installed on the shank of the fastener.

Upon release of actuator 52, tool 20 can be pulled to the right; and collet actuator 66, collet 62, and jaw assembly 60 are thereby restored in the direction of arrow 134 in FIG. 5 toward the initialized positions of those components depicted in FIG. 2. As the collet 62 and jaws 98 and 100 move toward the front of tool 20 the ledges 118 on the jaws engage the inner side 120 of housing end wall 70 while collet 62 continues to move forwardly until its forward end 96 reaches that surface. This separates the collet from jaws 98 and 100, leaving between the collet and jaws the gaps 140 shown in FIG. 5. These gaps allow jaws 98 and 100 to move apart. Therefore, at this point in the fastener installation process, with jaws 98 and 100 free to spring apart to their open positions shown in FIG. 2, the operator can simply slide tool 20 to the right; i.e., in the direction shown by arrow 138 in FIG. 5, off of the seated fastener 22.

Figure 7:
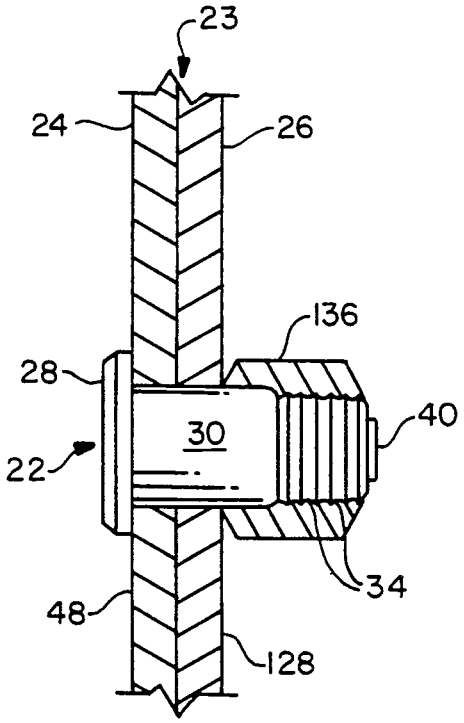
FIG. 7 is a section through the components and the fastener by which they are joined together, the installation of the fastener having been completed by swaging the collar onto the fastener and removing the pintail as the swaging step is completed.

The next step in the installation of fastener 22 (shown in FIG. 6) is to place a collar 136 on the shank 30 of fastener 22 in overlying relationship to that section of the shank in which parallel grooves 34 are formed. Thereafter, collar 136 is swaged onto fastener 22 while tension;—i.e., a force acting in the direction indicated by arrow 142 in FIG. 6—is maintained on the fastener. As a consequence of this force being exerted and the provision of necked down fastener section 40, pintail 36 will snap off as the swaging operation is completed, leaving the fastener installed as shown in FIG. 7.

The tool employed to swage collar 136 onto fastener 22 is not part of the present invention and has accordingly not been disclosed herein. Tools that have been specifically designed for this purpose are available from the above-mentioned Huck Manufacturing Company.

The invention may be embodied in forms other than those disclosed above without departing from the spirit or essential characteristics of the invention. The present embodiments are therefore to be considered in all respects as illustrative and not restrictive, the scope of the invention being indicated by the appended claims rather than by the foregoing description; and all changes which come within the meaning and range of equivalency of the claims are therefore intended to be embraced therein.

What is claimed is:

1. A tool for seating a fastener of the lockbolt type, said tool comprising: a housing with an end wall; jaws which are displaceable between open and closed positions and have cooperating means for gripping the pintail of the fastener upon said jaws being displaced to their closed positions, said jaws being rectilinearly displaceable in said housing to positions in which they protrude beyond the end wall of the housing; and means including a collet in said housing and rectilinearly displaceable relative to said jaws for sequentially: displacing the protruding jaws from their open to their closed positions to cause said jaws to grip said pintail, retract said jaws into said housing and thereby pull said fastener through the components to be joined and thus seat the fastener, and release said jaws for restoration to their open positions so that said tool can be removed from the fastener.

2. A tool as defined in claim 1 which includes a support for said collet and a link so extending directly from said support to said jaws that displacement of said collet support from a retracted position toward the end wall of the tool housing will allow said jaws to return to their protruding, open positions.

3. A tool for seating a fastener of the lockbolt type, said tool comprising: a housing with an end wall; jaws which are displaceable between open and closed positions and have cooperating means for gripping the pintail of the fastener upon said jaws being displaced to their closed positions, said jaws being rectilinearly displaceable in said housing to positions in which they protrude beyond the end wall of the housing; and means including a collet in said housing for sequentially: displacing the protruding jaws from their open to their closed positions to cause said jaws to grip said pintail, retract said jaws into said housing and thereby pull said fastener through the components to be joined and thus seat the fastener, and release said jaws for restoration to their open positions so that said tool can be removed from the fastener, said collet overlying said jaws and being rectilinearly displaceable in said housing and said jaws and said collet having cam surfaces so related that rectilinear movement of said collet in said housing will first displace said jaws to their closed, pintail gripping positions and then effect the fastener seating retraction of said jaws.

4. A tool as designed in claim 3 which includes a support for said collet and a link extending between said collet support and said jaws, said link being made of an elastically expansible material and thereby being capable of keeping said jaws in contact with said collet and the jaws thereby closed and clamped onto said pintail as said jaws are retracted to seat said fastener.

5. A tool for seating a fastener of the lockbolt type, said tool comprising: a housing with an end wall; jaws which are displaceable between open and closed positions and have cooperating means for gripping the pintail of the fastener upon said jaws being displaced to their closed positions, said jaws being rectilinearly displaceable in said housing to positions in which they protrude beyond the end wall of the housing; and means including a collet in said housing and surrounding said jaws for sequentially: displacing the protruding jaws from their open to their closed positions to cause said jaws to grip said pintail, retract said jaws into said housing and thereby pull said fastener through the components to be joined and thus seat the fastener, and release said jaws for restoration to their open positions so that said tool can be removed from the fastener.

6. A tool as defined in claim 5 in which one end of the collet surrounds the jaws, said tool also having a collet actuator which is axially aligned with the collet and attached said collet at the end thereof opposite the jaws.

* * * * *